United States Patent [19]

Schema

[11] Patent Number: 4,715,089

[45] Date of Patent: Dec. 29, 1987

[54] TELESCOPING POLE CRANK ASSEMBLY

[75] Inventor: Anthony C. Schema, Faribault, Minn.

[73] Assignee: Truth Incorporated, Owatonna, Minn.

[21] Appl. No.: 874,401

[22] Filed: Jun. 16, 1986

[51] Int. Cl.[4] ..... B25G 1/04

[52] U.S. Cl. ..... 16/115; 74/546; 279/42; 279/48

[58] Field of Search ..... 16/115, DIG. 41, DIG. 12; 74/545, 546, 548; 15/143 B, 144 B; 279/42, 48, 49

[56] References Cited

U.S. PATENT DOCUMENTS

| | | | |
|---|---|---|---|
| 738,445 | 9/1903 | Hoffmann . | |
| 1,730,820 | 10/1929 | Holden | 16/DIG. 12 X |
| 1,810,715 | 6/1931 | Larson et al. | 74/546 |
| 2,595,597 | 5/1952 | Morseth | 287/58 |
| 2,841,425 | 7/1958 | Oeters | 287/58 |
| 3,204,481 | 9/1965 | Golden | 74/551.1 |
| 3,380,097 | 4/1968 | Pharris | 15/145 |
| 4,325,157 | 4/1982 | Balint et al. | 16/115 X |
| 4,524,484 | 6/1985 | Graham | 16/115 |

OTHER PUBLICATIONS

Copy of p. 76 of Jul. 1983 Truth Incorporated catalog.

*Primary Examiner*—Nicholas P. Godici
*Assistant Examiner*—Carmine Cuda
*Attorney, Agent, or Firm*—Wood, Dalton, Phillips, Mason & Rowe

[57] ABSTRACT

A telescoping pole crank assembly having a tubular pole crank which movably mounts an extension pole for setting the overall length of the pole crank assembly. The extension pole is held in its adjusted position by a locking collar structure including a collar collet fixed to the pole crank and an outside collar rotatably mounted thereon for controlling the engagement of clamping fingers on the collar collet with the extension pole. The extension pole is rotationally interlocked with the pole crank by a series of elongated ribs formed on the extension pole which interfit with slots between clamping fingers of the collar collet. The components are held in assembled relation by rivets which interconnect the collar collet to the pole crank and with the rivets being held in position by the outside collar which is rotatably threaded on the collar collet and a coacting structure on the outside collar and the collar collet limit the separating movement of one with respect to the other after initial assembly.

9 Claims, 6 Drawing Figures

FIG. 1
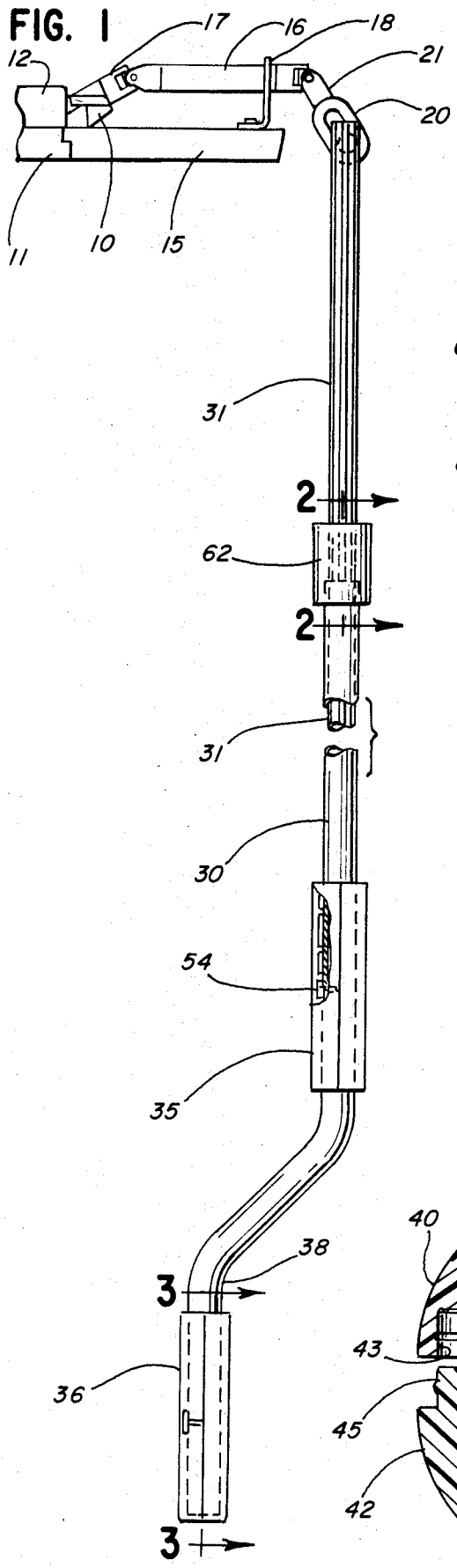
FIG. 2
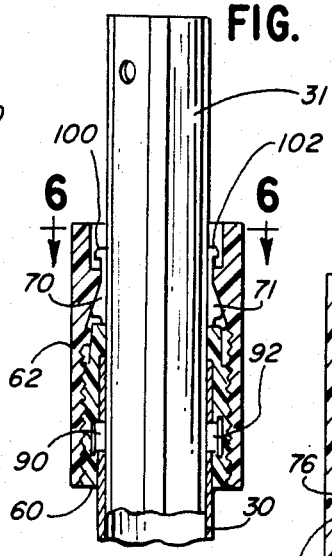
FIG. 5
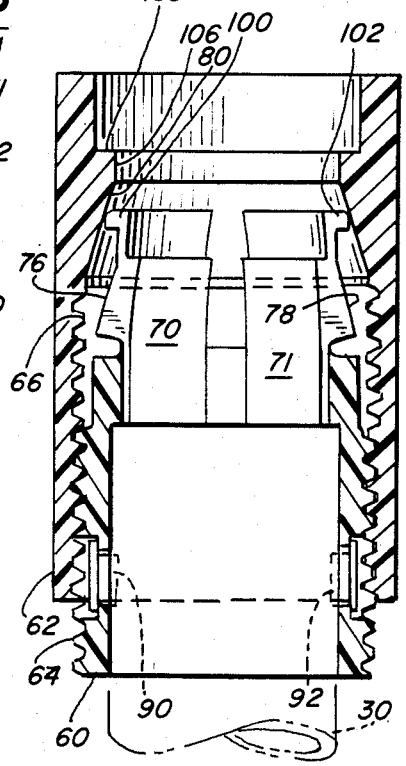
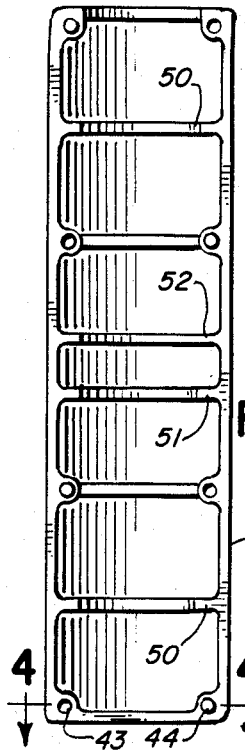
FIG. 3
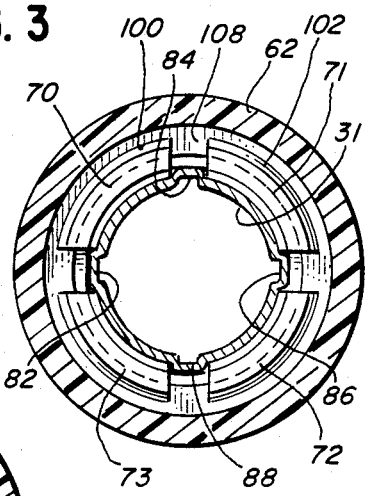
FIG. 6
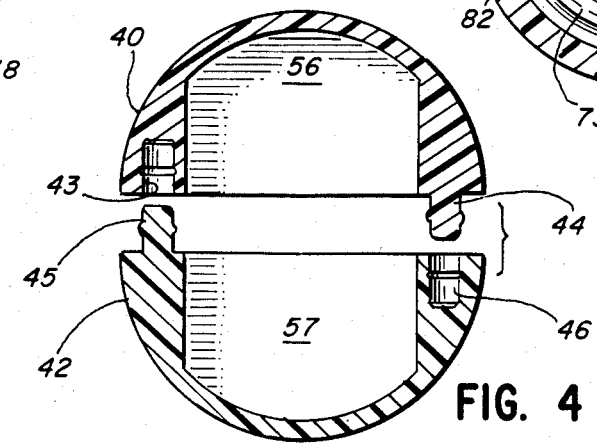
FIG. 4

TELESCOPING POLE CRANK ASSEMBLY

TECHNICAL FIELD

This invention pertains to a telescoping pole crank assembly which can be adjusted to different lengths by extension of an extension pole slidably received within a pole crank. The extension pole is locked in position to maintain the adjusted overall length for the assembly by means of a locking structure including an outside collar coacting with a collar collet and having a number of unique features. The telescoping pole crank assembly can have any one of several different drive options at an end of the extension pole depending upon the use thereof. A primary use of the telescoping pole crank assembly is in the operation of a window operator for a window which is located in an elevated remote position.

BACKGROUND ART

Present pole cranks for operating a window operator at an elevated location include a pole crank of fixed length, which in many cases can either be too short or too long. Also known is a pole crank having a fixed length with a detachable extension. This pole crank can be either too short or too long, even with the detachable extension and there is the inconvenience of storing and keeping track of two pieces. It is also known to have a telescoping pole crank with fixed incremental positions of extension without infinite adjustment to any length between minimum and maximum.

In the general art of extension poles and handles, there are structures providing infinite adjustment between minimum and maximum lengths and such structures include the use of locking collar structure. Prior art relating to extendible devices with locking structure includes the following patents; U.S. Pat. Nos. 735,445 Hoffman; 2,595,597 Morseth, 2,841,425 Oeters; 3,380,097 Pharris and 4,524,484 Graham.

DISCLOSURE OF INVENTION

A primary feature of the invention is to provide a telescoping pole crank assembly having a pole crank and a relatively movable extension pole adjustable to any length between minimum and maximum lengths, and which has new, improved structure for securely locking the adjustable components against relative movement.

Additional features of the invention embodied in the pole crank assembly include the structure of rotatable handles and their association with the pole crank; the coaction between the clamping fingers of a collar collet on the pole crank with ribs formed on an extension pole to assure against rotational slippage of the extension pole relative to the pole crank; the secure connection of the collar collet to the pole crank by means retained by the outer collar; and the structure of an outside collar and a collar collet which results in their being permanently locked together upon initial assembly.

An object of the invention is to provide a telescoping pole crank assembly wherein a tubular pole crank slidably mounts an extension pole which can be extended varying distances from the pole crank and having a unique locking collar structure for holding the extension pole in a position to maintain the overall length of the assembly. The locking collar structure includes a collar collet fixed to the pole crank at an end thereof and having a series of clamping fingers with slots therebetween and an outside collar threadably mounted to the collar collet. The collar collet and outside collar each have a circular ramp for camming the clamping fingers against the extension pole by rotation of the outside collar and the extension pole has at least one longitudinally extending rib for fitting within a slot between a pair of clamping fingers to prevent rotational slippage of the extension pole.

Another object of the invention is to provide a telescoping pole crank assembly as defined in the preceding paragraph wherein the pole crank has an offset end and a pair of handles are rotatably mounted on the pole crank with one being on the offset end. Each of said handles being formed of a pair of identical halves with a peg and hole structure providing for snap fit connection thereof in surrounding relation to the pole crank and with each handle having internal ribs for coaction with a screw threaded into the pole crank whereby the handle can rotate relative to the pole crank while being held against longitudinal movement relative thereto.

Still another object of the invention is to provide a telescoping pole crank assembly wherein the collar collet is held in association with the pole crank by a pair of loose rivets extended through aligned holes in the pole crank and the collar collet and with the holes in the collar collet being counterbored to receive the heads of the rivets. The outside collar retains the rivets in the holes by engagement of the rivet heads by the minor diameter of an internal thread in the outside collar which threadably mounts the outside collar on the collar collet.

An additional object of the invention is to provide a telescoping pole crank assembly having the aforesaid outside collar and collar collet and with these components being held in assembled relation by coaction between an essentially circular flange formed on the clamping fingers which coacts with a wall defined by a counterbore in an end of the pole crank. The initial assembly thereof is achieved by a circular ramp on the inside of the outside collar camming the clamping fingers inwardly by engagement with the circular flange whereby the circular flange is compressed to a reduced diameter to pass through a throat in the outside collar as it leaves the circular ramp and with the clamping fingers then expanding outwardly to place the circular flange behind the wall.

BRIEF DESCRIPTION OF THE DRAWINGS

FIG. 1 is an elevational view of the telescoping pole crank assembly with parts broken away;

FIG. 2 is a vertical section on an enlarged scale taken in general along line 2—2 in FIG. 1;

FIG. 3 is a vertical section on an enlarged scale taken generally along the line 3—3 in FIG. 1;

FIG. 4 is a transverse sectional view of a handle with two identical halves thereof in separated relation and taken through one of the halves generally along the line 4—4 in FIG. 3;

FIG. 5 is a view similar to FIG. 2 on a further enlarged scale and with the extension pole omitted illustrating the assembly of the outside collar and collar collet; and FIG. 6 is a sectional view taken generally along the line 6—6 in FIG. 2 and on a further enlarged scale.

BEST MODE FOR CARRYING OUT THE INVENTION

The telescoping pole crank assembly is shown in an operative position in FIG. 1 for remote operation of a window operator 10. The window operator 10 is located in an elevated position and is associated with the window structure including a sill 11, a cover 12 and a stool 15. In a typical application, the window operator 10 is connected to a handle extension 16 by a universal joint 17 with the handle extension being rotatably supported in a bearing bracket 18 and having a connection to a pole ring 20 by means of a universal joint 21.

The pole crank assembly has a tubular pole crank 30 and an extension pole 31 slidably mounted within the pole crank. The pole crank 30 has a pair of rotatable handles 35 and 36 with the latter handle being mounted on an offset end 38 of the pole crank. Each of the rotatable handles is of the same construction with the handle 36 being further illustrated in FIGS. 3 and 4. The handle 36 is made up of two identical halves 40 and 42 with each half having a row of openings 43 and pegs 44 along opposite edges. The handle is formed of a suitable plastic material whereby the pegs 44 can snap into the holes 43 and with a raised rib on the pegs interfitting with a circumferential groove in the holes of the other half. As seen in FIG. 4 the pegs 45 of the handle half 42 snap into the holes 43 of the handle half 40 and the pegs 44 of the handle half 40 snap into openings 46 of the handle half 42.

The handle halves for both handles have a series of internal flanges 50 as seen for handle half 40 in FIG. 3 which curvingly fit the pole crank 30. A pair of intermediate flanges 51 and 52 are positioned to either side of the head of a screw 54 threaded into the pole crank 30 whereby the handle is free to rotate on the pole crank while being held against movement lengthwise thereof. The handle halves 40 and 42 for the handle 36 are provided with end flaps 56 and 57 to close off the end of the pole crank 30. With the offset end 38 of the pole crank, an operator can grasp the handles 35 and 36 and impart rotation to the pole crank 30.

The pole crank assembly has infinite adjustment between minimum and maximum effective lengths and in one embodiment of the assembly, the overall length can be adjusted between 6 and 10 feet. This variation in length is achieved by the extent to which the extension pole 31 extends outwardly of the tubular pole crank 30.

The overall length is maintained by a locking structure including a collar collet 60 fixed to an end of the pole crank 30 and an outside collar 62 rotatably mounted on the collar collet by means of a threaded connection including an external thread 64 on the collar collet and an internal thread 66 on the outside collar. These parts can be molded of a suitable plastic material. The collar collet 60 has a tubular section fitted onto an end of the pole crank 30 and a plurality of integral flexible clamping fingers extending therefrom for surrounding relation with the extension pole 31. There are four of these clamping fingers identified at 70–73 each having an arcuate inner face for closely fitting the extension pole 31 and being spaced apart to provide a slot between each pair of clamping fingers for expansion and constriction and for a purpose to be described.

The locking action is achieved by the coaction between a pair of mating circular ramps on the collar collet and the outside collar. The circular ramp for the collar collet 60 is defined by arcuate sloped sections on the outer face of the each of the clamping fingers with the surfaces being identified at 76 and 78 for the clamping fingers 70 and 71. The circular ramp defined by part of the interior wall of the outside collar 62 is identified at 80. The clamping fingers are shown compressively engaged with the exterior of the extension pole 31 in FIG. 2 resulting from compressive engagement of the circular ramp 80 with the circular ramp on the collar collet. This is achieved by rotation of the outside collar 62 on the collar collet 60 which provides relative lengthwise movement. When the position of the extension pole 31 is to be adjusted relative to the pole crank 30, the outside collar 62 is rotated in a direction to cause the circular ramp 80 to move down the circular ramp on the collar collet and free the clamping fingers from compressive engagement.

Because the primary force transmitted by operation of the pole crank assembly is a rotational force, means are provided to rotationally interlock the pole crank and extension pole in order to not rely solely upon the clamping force exerted by the clamping fingers. This interlocking is achieved by formation of four longitudinally extending and arcuately spaced ribs 82, 84, 86 and 88 on the extension pole 31 which fit in the slots between the pairs of clamping fingers 70–73 of the collar collet and as shown in FIG. 6.

The collar collet 60 is fixed to the pole crank 30 by a pair of rivets 90 and 92 which fit within aligned holes in the collar collet 60 and the wall of the pole crank 30. The outer ends of the holes in the collar collet 60 are counterbored to receive the heads of the rivets and the tenons of the rivets are sufficiently short to not extend inwardly a distance sufficient to interfere with movement of the extension pole 31 within the pole crank 30. The rivets 90 and 92 are retained in position by a minor diameter of the internal thread 66 of the outside collar 62 as shown particularly in FIG. 5.

The locking collar structure is kept from disassembly by an essentially circular flange on the collar collet defined by circular flange segments at the exterior ends of the clamping fingers. The segments 100 and 102 for the clamping fingers 70 and 71 are seen in FIGS. 2 and 5.

In assembly, the collar collet 60 is associated with the pole crank 30 by placement of the rivets 90 and 92 in the aligned holes therein and the outside collar 62 is then threaded onto the collar collet in a downward direction as viewed in FIG. 5. This assembly is without the extension pole 31 positioned within the pole crank 30. With continued relative downward movement of the outside collar by rotation thereof, the circular ramp 80 thereof engages the circular flange at the end of the clamping fingers to reduce the diameter thereof, and upon further rotation of the outside collar, the circular flange can move through a throat 106 of the outside collar and expand outwardly to fit within a counterbore at the end of the outside collar which provides an abutment surface in the form of a wall 108. In this position, there cannot be separation of the outside collar from the collar collet. There can still be further rotation of the outside collar for movement thereof in the same direction lengthwise of the collar collet to cause a coaction between the mating circular ramps to achieve depressive engagement of the clamping fingers with the extension pole 31.

In use of the pole crank assembly, the desired overall length can be achieved by rotating the outside collar 62 in a direction to release the compressive engagement between the extension pole 31 and the clamping fingers and the extension pole 31 then adjusted lengthwise of the pole crank. When a desired length is set, the outside collar 62 is rotated in the direction to cause the clamping fingers of the collar collet to compressively engage the extension pole. Rotation of the pole crank by engagement with the handles 35 and 36 can transmit rotation to a remotely located window operator. Transmission of rotation is assured by the mechanical interlock between the clamping fingers of the collar collet and the extension pole 31. Because of the circular flange at the end of the clamping fingers of the collar collet, the lengthwise movement of the outside collar 62 relative to the collar collet 60, derived from rotation of the former, is not sufficient to uncover the rivets 90 and 92 whereby the collar collet is permanently secured to the pole crank 30. Additionally, removal of the outside collar from the collar collet is prevented.

I claim:

1. A telescoping pole crank assembly comprising, a tubular pole crank, an extension pole slidably mounted in said pole crank for movement outwardly thereof to establish the overall length of the pole crank assembly, and means for locking said extension pole to said pole crank to maintain said overall length including a collar collet fixed to said pole crank and having a plurality of arcuately spaced clamping fingers extended beyond an end of the pole crank with a slot between each pair of clamping fingers, an outside collar with internal threads threadably mounted on the collar collet for movement longitudinally thereof in response to the relative rotation, and a pair of coacting circular ramps on the exterior of the clamping fingers and the interior of said outside collar for compressing the clamping fingers by rotation of the outside collar and interfitting means on the collar collet and outside collar to prevent separation of one from the other comprising a throat opening to a counterbore in an end of the outside collar defining an annular abutment surface, and an effectively circular flange on the outer end of the clamping fingers having a diameter to abut against said abutment surface and being engageable by the outside collar for inward movement of the clamping fingers to a smaller diameter to pass through said throat upon assembly of the outside collar and collar collet and thereafter expand behind said abutment surface.

2. A telescoping pole crank assembly comprising, a tubular pole crank, an extension pole slidably mounted in said pole crank for movement outwardly thereof to establish the overall length of the pole crank assembly, and means for locking said extension pole to said pole crank to maintain said overall length including a collar collet fixed to said pole crank and having a plurality of arcuately spaced clamping fingers extended beyond an end of the pole crank with a slot between each pair of clamping fingers, an outside collar with internal threads threadably mounted on the collar collet for movement longitudinally thereof in response to the relative rotation, and a pair of coacting circular ramps on the exterior of the clamping fingers and the interior of said outside collar for compressing the clamping fingers by rotation of the outside collar, interfitting means on the collar collet and outside collar to prevent separation of one from the other, and said collar collet having a wall with a pair of aligned holes extending therethrough, a pair of holes in the wall of said pole crank aligned with said radial holes, a pair of rivets loosely fitted in said aligned holes to lock the collar collet to the pole crank, said holes in the collar collet being counterbored to receive the heads of the rivets, and said rivets being held in said aligned holes by the minor diameter of the internal threads on said outside collar.

3. A telescoping pole crank assembly comprising, a tubular pole crank, an extension pole slidably mounted in said pole crank for movement outwardly thereof to establish the overall length of the pole crank assembly, means for locking said extension pole to said pole crank to maintain said overall length including a collar collet fixed to said pole crank and having a plurality of arcuately spaced clamping fingers extended beyond an end of the pole crank with a slot between each pair of clamping fingers, and an outside collar threadably mounted on the collar collet for movement longitudinally thereof in response to relative rotation, and a pair of coacting circular ramps on the exterior of the clamping fingers and the interior of said outside collar for compressing the clamping fingers by rotation of the outside collar, at least one raised rib on the extension pole extending longitudinally thereof and positioned in one of said slots to prevent rotation of the extension pole relative to the pole crank, said collar collet having a wall with a pair of radial holes extending therethrough, a pair of holes in the wall of said pole crank aligned with said radial holes, a pair of rivets fitted in said aligned holes to lock the collar collet to the pole crank, said holes in the collar collet being counterbored to receive the heads of the rivets, and said rivets being held in said aligned holes by the minor diameter of the internal threads on said outside collar.

4. A telescoping pole crank assembly comprising, a tubular pole crank, an extension pole slidably mounted in said pole crank for movement outwardly thereof to establish the overall length of the pole crank assembly, means for locking said extension pole to said pole crank to maintain said overall length including a collar collet fixed to said pole crank and having a plurality of arcuately spaced clamping fingers extended beyond an end of the pole crank with a slot between each pair of clamping fingers, and an outside collar threadably mounted on the collar collet for movement longitudinally thereof in response to relative rotation, and a pair of coacting circular ramps on the exterior of the clamping fingers and the interior of said outside collar for compressing the clamping fingers by rotation of the outside collar, at least one raised rib on the extension pole extending longitudinally thereof and positioned in one of said slots to prevent rotation of the extension pole relative to the pole crank and means for holding the outside collar and collar collet in assembled relation comprising, a throat opening in a counterbore in an end of the outside collar defining an annular abutment surface, and an effectively circular flange on the outer end of the clamping fingers having a diameter to abut against said abutment surface and being engageable by the circular ramp on the outside collar for inward movement of the clamping fingers to a smaller diameter to pass through said throat upon assembly of the outside collar and collar collet and thereafter expand behind said abutment surface.

5. A telescoping pole crank assembly comprising, a tubular pole crank, an extension pole slidably mounted in said pole crank for movement lengthwise thereof to establish the overall length of the pole crank assembly, means for locking said extension pole to said pole crank to maintain said overall length including a collar collet fixed to said pole crank and having a plurality of arcuately spaced clamping fingers extended beyond an end of the pole crank with a slot between each pair of clamping fingers, an outside collar with internal threads threadably mounted on the collar collet for movement longitudinally thereof in response to the relative rotation, and a pair of coacting circular ramps on the exterior of the clamping fingers and the interior of said outside collar for compressing the clamping fingers by rotation of the outside collar, and means for fastening the collar collet to the pole crank including aligned holes in said collet collet and pole crank, a pair of loose rivets one in each of said aligned holes, and said rivets being captured by said outside collar in surrounding relation to said collar collet.

6. A telescoping pole crank assembly comprising, a tubular pole crank with an offset end, a pair of pole handles rotatably mounted on said pole crank with one handle positioned on said offset end, an extension pole slidably mounted in said pole crank for movement lengthwise thereof to establish the overall length of the pole crank assembly, and means for locking said extension pole to said pole crank to maintain said overall length including a collar collet fixed to said pole crank and having a plurality of arcuately spaced clamping fingers extended beyond an end of the pole crank with a slot between each pair of clamping fingers, an outside collar with internal threads threadably mounted on the collar collet for movement longitudinally thereof, in response to the relative rotation, and a pair of coacting circular ramps on the exterior of the clamping fingers and the interior of said outside collar for compressing the clamping fingers by rotation of the outside collar, and at least one raised rib on the extension pole extending longitudinally thereof and positioned in one of said slots to prevent rotation of the extension pole relative to the pole crank, each of said handles being formed of two identical halves with each half having a peg and a hole for a snap fit connection to the other half, a pair of screws extending from the pole crank at the location of the handles, and a pair of internal ribs on each handle capturing one of the screws therebetween to enable handle rotation without movement lengthwise of the pole crank.

7. A telescoping pole crank assembly comprising, a tubular pole crank with an offset end, a pair of pole handles rotatably mounted on said pole crank with one handle positioned on said offset end, an extension pole slidably mounted in said pole crank for movement lengthwise thereof to establish the overall length of the pole crank assembly, and means for locking said extension pole to said pole crank to maintain said overall length including a collar collet fixed to said pole crank and having a plurality of arcuately spaced clamping fingers extended beyond an end of the pole crank with a slot between each pair of clamping fingers, an outside collar with internal threads threadably mounted on the collar collet for movement longitudinally thereof, in response to the relative rotation, and a pair of coacting circular ramps on the exterior of the clamping fingers and the interior of said outside collar for compressing the clamping fingers by rotation of the outside collar, at least one raised rib on the extension pole extending longitudinally thereof and positioned in one of said slots to prevent rotation of the extension pole relative to the pole crank, and said collar collet having a wall with a pair of radial holes extending therethrough, a pair of holes in the wall of said pole crank aligned with said radial holes, a pair of rivets loosely fitted in said aligned holes to lock the collar collet to the pole crank, said holes in the collar collet being counterbored to receive the heads of the rivets, and said rivets being held in said aligned holes by the minor diameter of the internal threads on said outside collar.

8. A telescoping pole crank assembly comprising, a tubular pole crank with an offset end, a pair of pole handles rotatably mounted on said pole crank with one handle positioned on said offset end, an extension pole slidably mounted in said pole crank for movement lengthwise thereof to establish the overall length of the pole crank assembly, and means for locking said extension pole to said pole crank to maintain said overall length including a collar collet fixed to said pole crank and having a plurality of arcuately spaced clamping fingers extended beyond an end of the pole crank with a slot between each pair of clamping fingers, an outside collar with internal threads threadably mounted on the collar collet for movement longitudinally thereof, in response to the relative rotation, and a pair of coacting circular ramps on the exterior of the clamping fingers and the interior of said outside collar for compressing the clamping fingers by rotation of the outside collar, at least one raised rib on the extension pole extending longitudinally thereof and positioned in one of said slots to prevent rotation of the extension pole relative to the pole crank, and means for holding the outside collar and collar collet in assembled relation comprising, a throat opening in a counterbore in an end of the outside collar defining an annular abutment surface, and an effectively circular flange on the outer end of the clamping fingers having a diameter to abut against said abutment surface and being engageable by the circular ramp on the outside collar for inward movement of the clamping fingers to a smaller diameter to pass through said throat upon assembly of the outside collar and collar collet and thereafter expand behind said abutment surface.

9. A telescoping pole crank assembly as defined in claim 8, wherein each of said handles is formed of two identical halves with each half having a peg and a hole for a snap fit connection to the hole and peg of the other half.

* * * * *